United States Patent [19]

Bocourt et al.

[11] 4,372,541

[45] Feb. 8, 1983

[54] APPARATUS FOR TREATING A BATH OF LIQUID METAL BY INJECTING GAS

[75] Inventors: Francois Bocourt, Sydney, Australia; Henri Fetaud, Chambery, France

[73] Assignee: Aluminum Pechiney, Lyons, France

[21] Appl. No.: 303,868

[22] Filed: Sep. 21, 1981

[30] Foreign Application Priority Data

Oct. 14, 1980 [FR] France ..... 80 22193

[51] Int. Cl.[3] ..... C21C 5/48

[52] U.S. Cl. ..... 266/220; 75/61; 75/93 R; 266/236

[58] Field of Search ..... 266/220, 236; 75/93 R, 75/61; 261/68, 70, 120

[56] References Cited

U.S. PATENT DOCUMENTS 3,640,702 2/1972 Karinthi ..... 75/58

3,651,825 3/1972 Sury ..... 266/236

*Primary Examiner*—P. D. Rosenberg

*Attorney, Agent, or Firm*—McDougall, Hersh & Scott

[57] ABSTRACT

The present invention concerns apparatus for treating a bath of liquid metal and in particular aluminum or alloys thereof by injecting gas, comprising a rotary agitator, the lower end of which, in the rest condition, rests on a gas injection plug disposed at the bottom of the bath and which, under the action of the pressure of the gas emitted by the plug, rises and, thus being supported by a fluid bearing, may, under the effect of an external couple, rotate freely about its axis and allow a multitude of regularly dispersed gas bubbles to escape through the space which separates the agitator from the plug, enabling intimate contact between the gas and the liquid metal and thus to improve the efficiency of the treatment. It may be used in treating metals from which hydrogen and non-metallic impurities are to be removed.

15 Claims, 3 Drawing Figures

APPARATUS FOR TREATING A BATH OF LIQUID METAL BY INJECTING GAS

FIELD OF INVENTION

The present invention relates to an apparatus for treating a bath of liquid metal and in particular aluminum or alloys thereof, by injecting gas.

BACKGROUND OF THE INVENTION

The man skilled in the art knows that, before proceeding to an operation of shaping semi-finished metallurgical products, the basic metal produced has to be subjected to treatment to remove therefrom dissolved gases and non-metallic impurities that it contains, the presence of which would detrimentally affect the desired properties and the easy solidification of the manufactured articles.

Two main treatment processes are known at the present time: the first comprises passing the liquid metal through inert or active filtration agents which retain the impurities, either mechanically or as a consequence of chemical reactions or by combinations thereof, while the second method involves using inert or reactive gases or mixtures thereof which are mixed by stirring more or less intensively with the liquid metal, with or without substances, such as fluxes, being present. However, these two main methods may be used in combination with each other.

In the second method, many alternative forms have been advanced, relating interalia to the manner of introducing ducing the gas into the bath of liquid metal, and the way of achieving greater or lesser dispersion of the gases in the metal. Thus, in French patent No. 1,535,953, the gas is introduced into the bath by a plunger arrangement, the lower part of which is provided with a rotary device for producing the stirring effect and distributing the gas over a large area of the bath.

In French patent No. 2,063,906, the gas is blown into the molten metal by means of a lance having a water-cooled double jacket.

In French patent No. 2,156,014, gases are injected in the form of small discrete bubbles by means of a device comprising a rotary shaft which is fixed with respect to a bladed rotor, and a fixed sleeve which is disposed around said shaft and which is connected at the lower end to a bladed stator; the shaft and the sleeve are separated by an axial-passage in which the gases are carried and introduced at the level of the blades where they are subdivided into small bubbles and brought into intimate contact with the metal which is agitated by the rotor.

In French patent No. 2,200,364, the gas is introduced at the center of rotation of a turbine agitator and brought into contact with the liquid metal under conditions of agitation which are such as to avoid any emulsification.

Many solutions have been proposed. However, each of those suffers from disadvantages. Thus, the apparatuses which involve injection of gas by way of an agitator have recourse to the use of gas distribution ducts which are disposed within the agitator, which complicates design of the arrangement and results in delicate systems which are expensive to maintain; moreover, such ducts are the cause of substantial pressure drops which limit the speed of injection of the gas into the bath. In addition, the speed of rotation of such arrangements and consequently their capability for dispensing the gases and agitating the bath is limited by the appearance of imbalance effects and abrasion phenomena. Certainly, it is possible to take steps against such imbalance phenomena by supporting the shafts of the agitators at their lower ends, but in that case it is necessary either to provide support bearings which operate in contact with liquid metal at a relatively high temperature or to extend the shafts to the outside of the metal container and provide them with rotary sealing means. These are solutions which give rise to technological difficulties that are often impossible to overcome.

OBJECT OF THE INVENTION

It is for this reason that the applicants sought to produce and develop apparatus for treating a bath of liquid metal by injecting gas, wherein the supply of gas by way of the shaft of the agitator and all the design complications resulting therefrom are eliminated; the imbalance and abrasion phenomena are limited; and a gas bubble lamination and dispersion effect is obtained, such that the efficiency of treatment of the metal is substantially enhanced thereby.

BRIEF DESCRIPTION OF THE INVENTION

The apparatus for treating a bath of liquid metal in a container by injecting gas is characterized in that it comprises a rotary agitator, the lower end of which, in the rest condition, rests on a gas injection plug disposed at the bottom of the bath and which, under the action of the pressure of the gas emitted by the plug, rises and, thus being supported by a fluid bearing, may, under the effect of an external couple, rotate freely about its axis and allow a multitude of regularly dispersed gas bubbles to escape through the space which separates the agitator from the plug.

The apparatus according to the invention is therefore formed by the combination of two means: a rotary agitator on the one hand and a gas injection plug on the other hand.

The rotary agitator comprises a solid member of cylindro-frustoconical shape, the upper portion of which is provided with a cylindrical opening which requires engagement with the shaft to which an external couple is applied. The lower portion of the agitator may have a smooth surface or may have a plurality of radial notches or grooves whose depth increases towards the periphery, so as to facilitate entrainment of the injection gases. The grooves are dimensioned to have a length, for example, which extends over approximately one third of the diameter of the agitator and may be extended onto the side face, forming kinds of right-hand or left-hand helices, which are of greater or smaller pitch, depending on the treatment operation conditions.

The shaft of the agitator is provided with an anti-vortex system which is disposed at the bath-atmosphere interface so as to limit movements of the liquid metal which could detrimentally affect satisfactory dispersion of the gases.

The external couple is preferably applied by a variable-speed motor which is fixed on a carrier disposed in the upper part of the container.

The shaft of the motor is fixed with respect to the shaft of the agitator by way of any connecting system which permits the agitator to be able to describe a vertical translatory movement over a distance of several millimeters.

The gas injection plug comprises a cylindrical member, the upper face of which is provided with apertures of small diameter, which may be disposed in rings and which are connected within the plug to ducts which come together at a central duct which opens into an expansion chamber that is supplied with gas by a conduit outside the container.

In accordance with another embodiment of the invention, the mass of the plug, which is disposed above the expansion chamber, may be made of a porous material.

The agitator and the plug are so disposed relative to each other that each of their vertical axes of symmetry coincide.

The lower face of the agitator and the upper face of the plug are matched to each other so that, in the rest condition, they are in contact with each other and block the gas injection apertures.

This matching configuration may be produced, for example, by the face of the plug being of a conical configuration and by forming a cavity of similar shape in the face of the agitator.

In operation of the apparatus, the pressure of gas which is introduced at the level of the plug raises the agitator and produces a fluid bearing so that, when the drive motor is set in operation, the agitator may turn freely without contact with the plug.

In this way, it is possible to achieve high speeds of rotation without the danger of wear to the bearing; in addition, the matching configuration which is achieved in particular with conical surfaces, combined with the injection of gas, ensures that the agitator is properly centered and limits imbalance. Under these conditions, there is provided a robust apparatus which produces intense stirring of the bath and lamination of the gas in the space between the plug and the agitator, so that the gas escapes into the metal in the form of a multitude of regularly dispersed bubbles. This results in intimate contact between the gas and the metal, and gives a remarkable level of efficiency in treatment.

The agitator and the plug are preferably formed of graphite, but any other material which has sufficient resistance to the liquid metal is also suitable.

The gas which is introduced by way of the plug is a neutral gas, such as argon or nitrogen, or a reactive gas, such as chlorine or mixtures thereof, or any other gas selected for treating the material.

An arrangement of this nature is set in position on a container containing the bath of metal to be treated. The container may be, for example, a ladle through which the material passes continuously before being cast. The container may conventionally comprise a partitioning wall means and, in which case, the apparatus is disposed in the upstream compartment. The bottom of the ladle may or may not be provided with a filter bed. The ladle usually is provided with means which permit a neutral atmosphere to be maintained at the surface of the liquid metal, thus to avoid any oxidizing action by the outside air.

The container may also be provided with heating means for maintaining the metal in a liquid state.

DESCRIPTION OF THE DRAWINGS

The present invention will be better appreciated by means of the accompanying drawings which show a particular, but non-limiting, type of apparatus and in which.

DETAILED DESCRIPTION OF THE INVENTION

Figure 1:
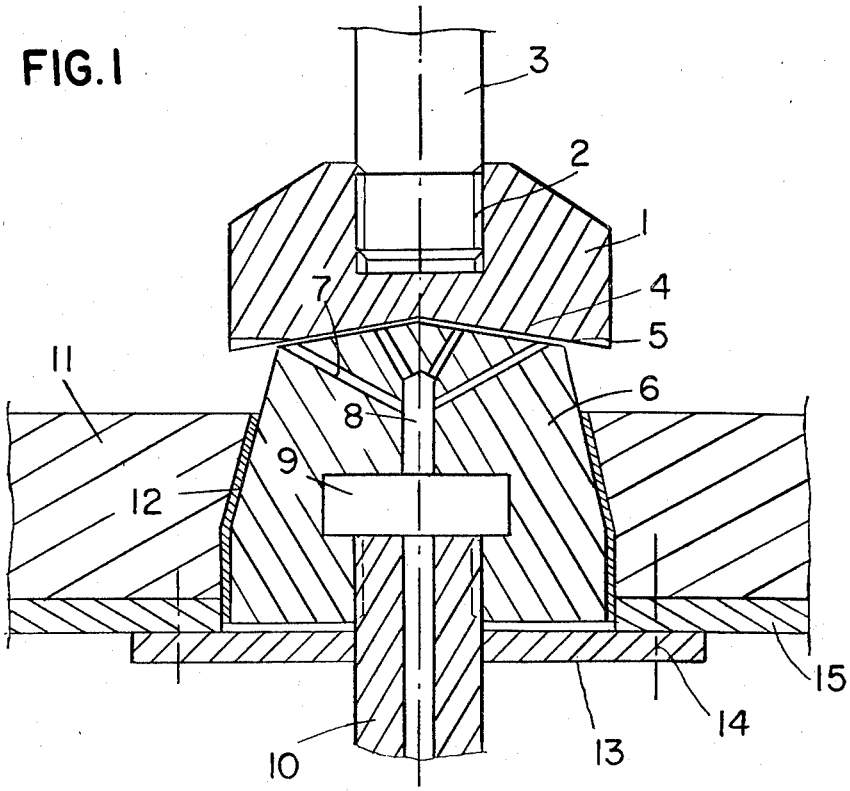
FIG. 1 is a sectional elevational view of the agitator-plug apparatus embodying the features of this invention.

Referring to FIG. 1, illustrated therein are:

the agitator 1 which is held by a screw thread 2 on the shaft 3 and the lower portion of which has a conical surface 4 provided with notches or grooves 5;

an injection plug 6 which has a conical surface at which there open ducts 7 which eminate from a central duct 8 extending from an expsnion chamber 9 which is supplied by gas by way of a conduit 10. The plug is inserted into the lining 11 of a casting ladle, by means of an insulating seal 12, and held in place by a plate 13 which is bolted, as at 14, to the metal structure 15 of the ladle.

Figure 2:
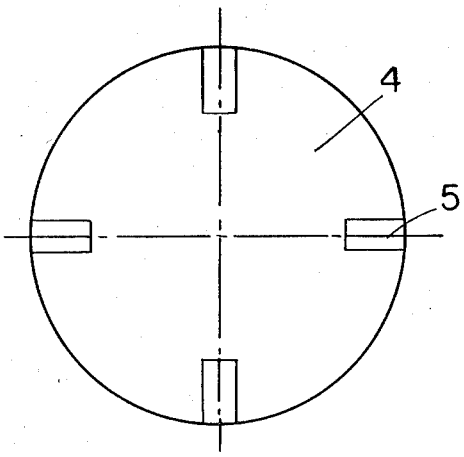
FIG. 2 is a view from the bottom side of FIG. 1.

FIG. 2 shows the arrangement of the grooves or notches 5 on the conical surface 4 of the lower portion of the agitator 1.

Figure 3:
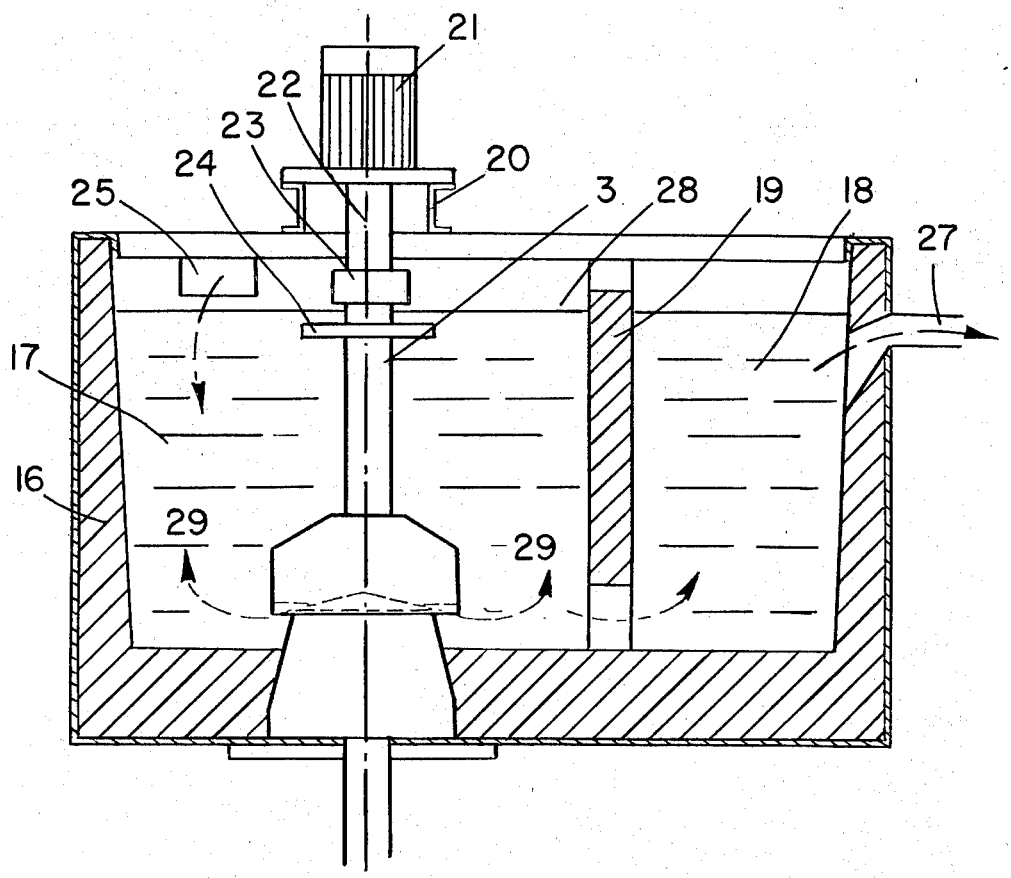
FIG. 3 is a sectional elevational view of the apparatus installed on a continuous casting ladle.

Referring now to FIG. 3, shown therein is the apparatus according to the invention, on a casting ladle 16 which is divided into two compartments, namely, an upstream compartment 17 and a downstream compartment 18, by a partitioning wall means 19. A motor 21 rests on a bracket 20 which is disposed in the upper part of the ladle. The rotary shaft 22 of the motor 21 is connected to the shaft 3 of the agitator by a system 23 which enables relative vertical movement of the shaft 3. The shaft may be provided with an anti-vortex system 24.

The ladle is supplied with liquid metal by way of the runner channel 25. The liquid metal flows towards the bottom of the upstream compartment, and then below the partitioning wall means 19 to the downstream compartment, before leaving the ladle by way of the runner channel 27.

As it passes through the upstream compartment, the metal of the bath which is delimited by the walls of the ladle and the surface 28, is intimately stirred by the agitator, with the formation of a multitude of finely dispersed gas bubbles which escape under the pressure of the gases, by way of the space 29 which is formed, between the lower portion of the agitator and the upper portion of the plug.

The present invention is illustrated by the results obtained in the course of tests using the above-described apparatus; these results are given by way of illustration and not by way of limitation of the scope of the present invention.

The metal to be treated was an alloy of aluminum of series 6CCO which was introduced into a casting ladle in a molten state at a temperature of close to 720° C., at a flow rate of 5 tons per hour; the height of the bath in the ladle was 80 cm.

The plug, of the type comprising ducts, was supplied with argon at a rate of about 2 $m^3/h$ and at a pressure of between 1.2 and 1.4 bar.

The agitator was rotated at a speed of 400 rpm.

On entering the ladle, the alloy had 10 bubbles in the vacuum solidification test, while after passing through the ladle, the number of bubbles was zero. This shows the efficiency of the treatment which is achieved by means of the claimed apparatus.

The present invention finds use in the treatment of liquid metals with a gas and in particular in the treatment of aluminum or alloys thereof for removing hydrogen and non-metallic impurities.

We claim:

1. Apparatus for treating a bath of liquid metal by injection of a gas comprising a container for housing the liquid metal, a gas injection plug at the bottom of the container, an agitator mounted for rotational movement within the container, means mounting the agitator for vertical movement in the direction toward and away from the plug between rest position on the gas injection plug and raised position spaced from the gas injection plug responsive to gas emission from the plug, whereby the agitator is supported in raised position by a fluid bearing to enable rotational movement of the agitator in raised position while allowing a multitude of dispersed bubbles of the gas to escape through the space between the separated agitator and plug, and means for rotating the agitator about the axis.

2. Apparatus for treating a bath of liquid metal as claimed in claim 1 in which the container is a casting ladle and which includes a partitioning wall separating the ladle into two compartments.

3. Apparatus for treating a bath of liquid metal as claimed in claim 1 in which the plug is fixed with respect to the bottom of the container.

4. Apparatus for treating a bath of liquid metal as claimed in claim 1, in which the agitator and the plug are of materials which are not corroded by liquid aluminum.

5. Apparatus for treating a bath of liquid metal as claimed in claim 4, in which the material which is not corroded by liquid aluminum is graphite.

6. Apparatus for treating a bath of liquid metal as claimed in claim 1, in which the vertical axes of symmetry of the plug coincides with axes of the agitator.

7. Apparatus for treating a bath of liquid metal as claimed in claim 1, in which the means for rotating the agitator is a variable-speed motor.

8. Apparatus for treating a bath of liquid metal as claimed in claim 1, in which the means for rotating the agitator includes a driving motor and an external couple between the driving motor and agitator which couple is applied to the agitator by way of a system which permits a vertical translatory movement.

9. Apparatus for treating a bath of liquid metal as claimed in claim 1, in which the upper face of the plug and the lower face of the agitator are of a conical shape.

10. Apparatus for treating a bath of liquid metal as claimed in claim 1, which includes an agitator shaft provided with an anti-vortex system positioned at the metal-atmosphere interface.

11. Apparatus for treating a bath of liquid metal as claimed in claim 1, which includes a plurality of radial grooves in the lower portion of the agitator.

12. Apparatus for treating a bath of liquid metal as claimed in claim 11, in which the grooves are extended onto the side face of the agitator in the form of helices.

13. Apparatus for treating a bath of liquid metal as claimed in claim 1, which includes ducts in the plug and a plurality of apertures in the upper face of the plug connecting the plug to the ducts.

14. Apparatus for treating a bath of liquid metal as claimed in claim 1, which includes an internal expansion chamber in the plug.

15. Apparatus for treating a bath of liquid metal as claimed in claim 14, in which the mass of the plug which is above the expansion chamber is made of a porous material.

* * * * *